US006182540B1

(12) United States Patent
Wang

(10) Patent No.: US 6,182,540 B1
(45) Date of Patent: Feb. 6, 2001

(54) WRENCH AND PLIER DEVICE COMBINATION

(76) Inventor: Jenn Liang Wang, No. 7, Avenue 6, Lane 296, Peng Yii Road, Taiping City, Taichung Hsien (TW), 411

( * ) Notice: Under 35 U.S.C. 154(b), the term of this patent shall be extended for 0 days.

(21) Appl. No.: 09/450,044

(22) Filed: Nov. 29, 1999

(51) Int. Cl.[7] ..... B25B 23/16
(52) U.S. Cl. ..... 81/177.4; 81/490; 7/138
(58) Field of Search ..... 81/177.4, 490; 7/106, 118, 125, 138, 158, 167, 170

(56) References Cited

U.S. PATENT DOCUMENTS 888,795 * 5/1908 Fields ..... 7/118
1,811,982 * 6/1931 Soustre ..... 7/118
2,467,658 * 4/1949 Carnelli ..... 81/99
5,251,353 * 10/1993 Lin ..... 7/128

* cited by examiner

*Primary Examiner*—James G. Smith
*Assistant Examiner*—David B. Thomas
(74) *Attorney, Agent, or Firm*—Charles E. Baxley

(57) ABSTRACT

A wrench includes a chamber formed in one end for receiving a pivotal casing which is used for receiving and storing a plier device, and includes the other end having a pivotal jaw biased to engage with a fixed jaw. The wrench includes a pair of plates disposed parallel to each other for forming the chamber. The casing includes a base wall and two side walls and an end wall for forming a space to receive the plier device, particularly a foldable plier device. A latch is slidably engaged in the handle portion for engaging with and for locking the casing to the handle portion.

13 Claims, 4 Drawing Sheets

WRENCH AND PLIER DEVICE COMBINATION

BACKGROUND OF THE INVENTION

1. Field of the Invention

The present invention relates to a wrench, and more particularly to a wrench having a plier device.

2. Description of the Prior Art

Typical wrenches may be used for driving fasteners only and comprise a compact configuration having no spaces or chambers for receiving the other tools, particularly the plier devices. For some working conditions, the workers may require to use both wrenches and plier devices frequently and alternatively to actuate the fasteners. None of the typical tools provide a tool combination having both the wrench and the plier device.

The present invention has arisen to mitigate and/or obviate the afore-described disadvantages of the conventional wrenches and plier devices .

SUMMARY OF THE INVENTION

The primary objective of the present invention is to provide a wrench and plier device combination including a plier device received in the wrench for allowing the users to easily obtain both or either of the wrench and the plier device.

In accordance with one aspect of the invention, there is provided a wrench and plier device combination comprising a wrench body including a first end having a wrench tool provided therein, and including a second end having a chamber formed therein, a casing rotatably secured to the second end of the wrench body at a pivot pin and rotatable outward of the chamber of the wrench body and rotatable inward and received in the chamber of the wrench body, and a plier device received in the casing and received in the wrench body when the casing is received in the chamber of the wrench body.

The wrench tool includes a fixed jaw provided on the first end of the wrench body and includes a second jaw rotatably secured to the first end of the wrench body at a pivot shaft and rotatable toward the fixed jaw, and means for biasing the second jaw toward the fixed jaw.

The casing includes a side wall and an end wall for forming a space therein and for receiving the plier device. The wrench body includes a pair of plates disposed parallel to each other and having a coupling portion coupled together at a panel for forming the chamber therein, the panel of the wrench body and the side wall and the end wall of the casing together form the space in the casing and the wrench body for receiving the plier device. The panel of the wrench body includes a length shorter than that of the casing for allowing the casing to be rotated outward of the handle portion of the wrench body.

The plier device is a foldable plier device and includes a pair of jaws pivotally secured together at a pivot axle, a pair of hand grips pivotally secured to the jaws respectively at a pivot rod for allowing the hand grips to be rotated and folded relative to the jaws of the plier device. The hand grips of the plier device each includes a cavity formed therein for receiving the jaws of the plier device when the jaws are rotated and folded relative to the hand grips.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
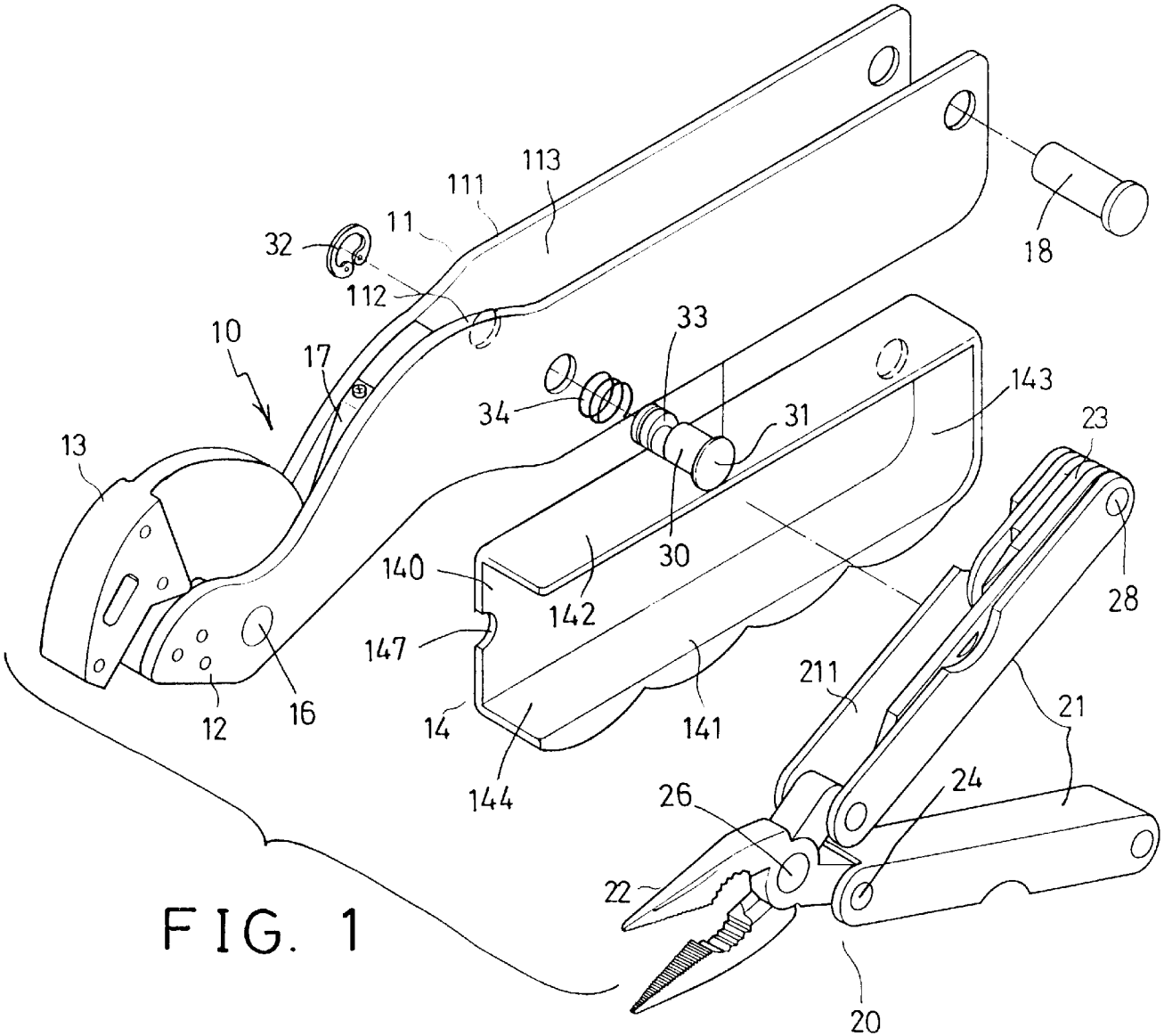
FIG. 1 is a partial exploded view of a wrench and plier device combination in accordance with the present invention.
Figure 2:
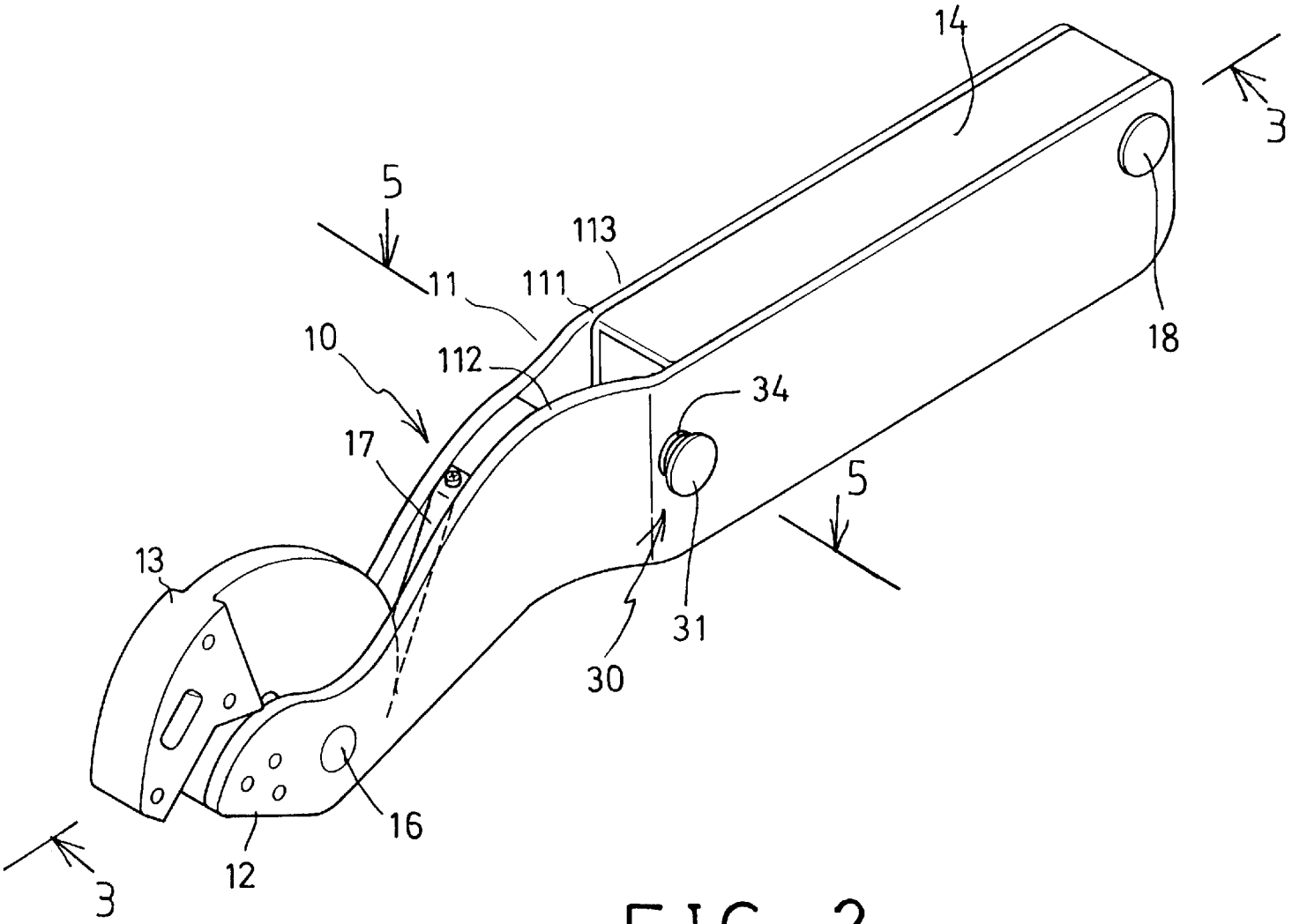
FIG. 2 is a perspective view of the wrench and plier device combination.
Figure 3:
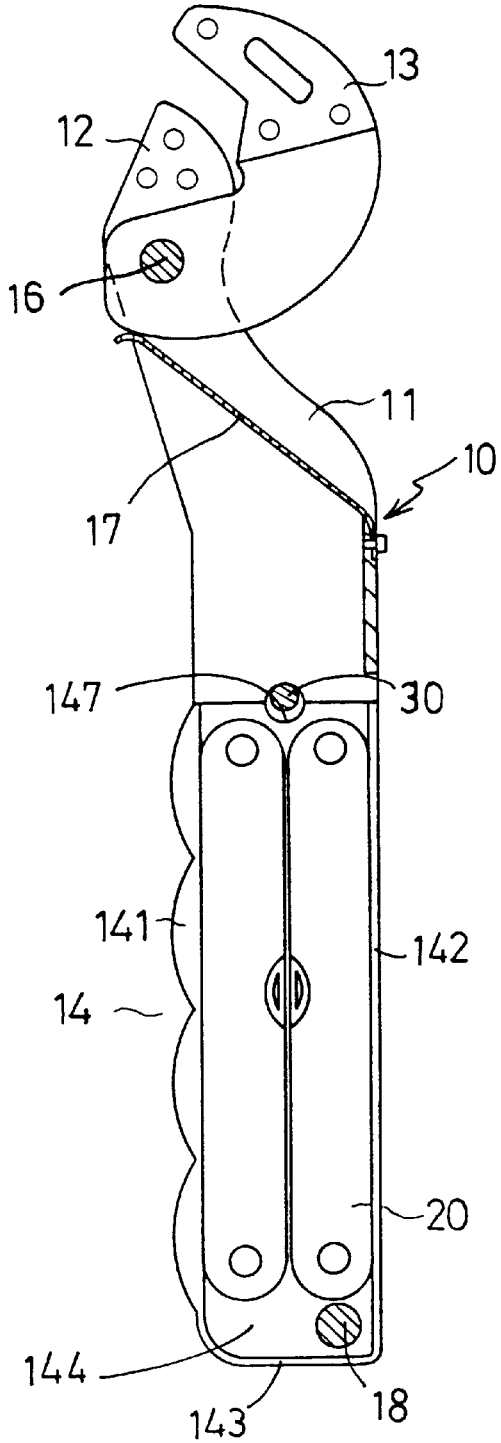
FIG. 3 is a cross sectional view taken along lines 3—3 of FIG. 2.

Referring to the drawings, and initially to FIGS. 1–3, a wrench and plier device combination in accordance with the present invention comprises a wrench body 10 including a handle portion 11 having a fixed jaw 12 provided on one end thereof and having a pivotal jaw 13 pivotally secured to the one end of the wrench body 10 at a pivot shaft 16 for allowing the pivotal jaw 13 to be rotated away from and toward the fixed jaw 12 for conducting a wrenching operation. A spring member 17 has one end secured to the wrench body 10 and has the other end engaged with the pivotal jaw 13 for biasing the pivotal jaw 13 toward and to engage with the fixed jaw 12. The wrench body 10, particularly the handle portion 11 of the wrench body 10 includes a pair of plates 111, 112 disposed substantially parallel to each other for defining a chamber 113 therebetween.

Figure 4:
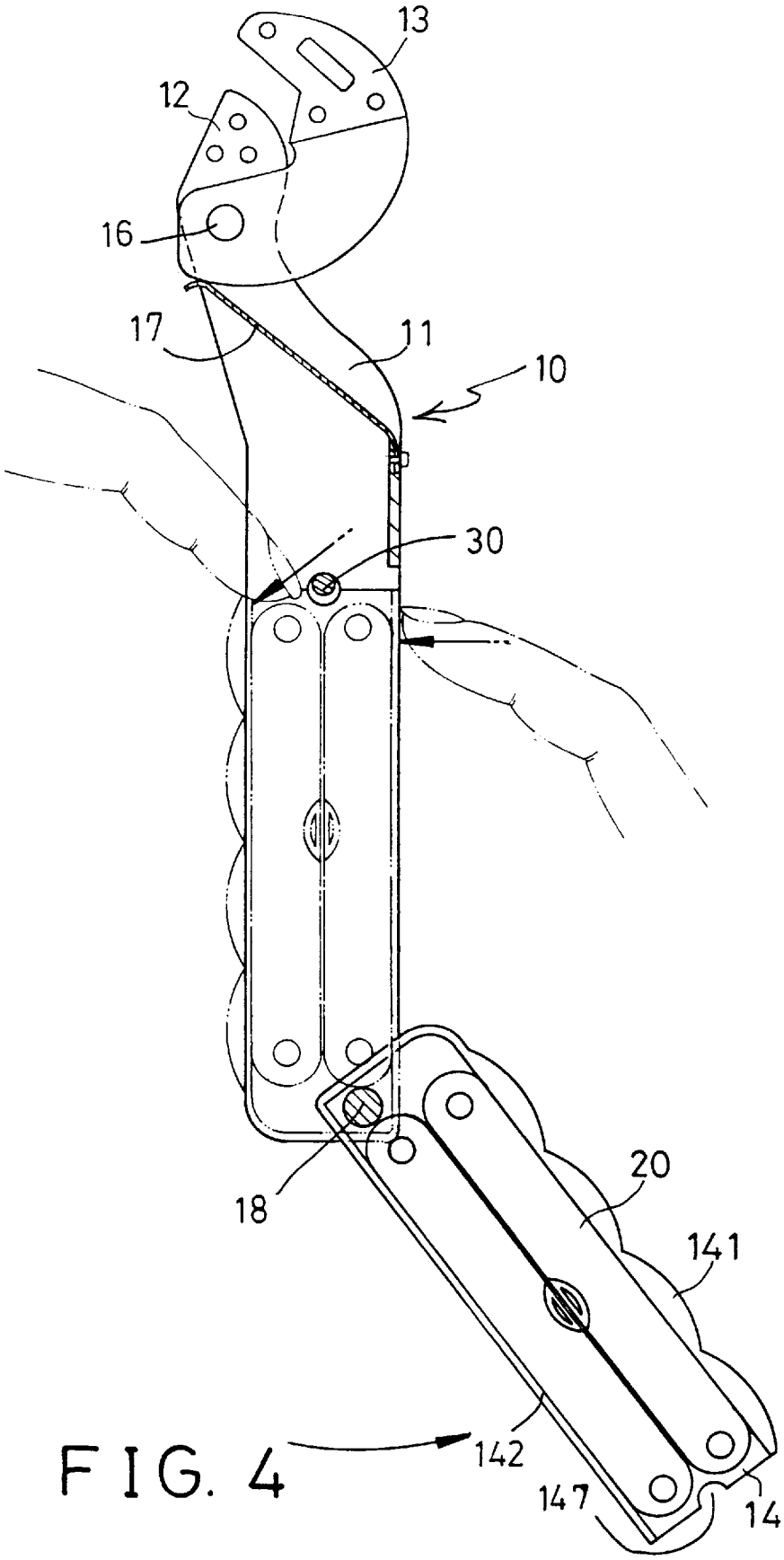
FIG. 4 is a cross sectional view similar to FIG. 3, illustrating the operation of the wrench and plier device combination.

A casing 14 has one end pivotally secured to a free end, such as the bottom end of the handle portion 11 of the wrench body 10 at a pivot pin 18 for allowing the casing 14 to be rotated outward and inward of the chamber 113 of the handle portion 11. The casing 14 includes a base wall 140, a pair of opposite side walls 141, 142, and an end wall 143 for forming a space 144 therein and for receiving a plier device 20 therein (FIGS. 3, 4). The casing 14 has an open end portion and an open portion opposite to the base wall 140 for allowing the plier device 20 to be engaged into and out of the casing 14. The base wall 140 of the casing 14 includes a depression 147 formed therein. The plier device 20 is preferable a foldable plier device having a pair of hand grips 21 secured to a pair of jaws 22 respectively at a pivot rod 24 for allowing the hand grips 21 to be folded relative to the jaws 22 and for allowing the jaws 22 to be folded into the cavities 211 of the hand grips 21. The jaws 22 of the plier device 20 are pivotally secured together at a pivot axle 26. One or more further tool members 23, such as the screw driver bits, knives etc. may further be rotatably secured to the hand grips 21 at a pivot pole 28 for allowing the tool members 23 to be folded and received in the cavities 211 of the hand grips 21.

Figure 5:
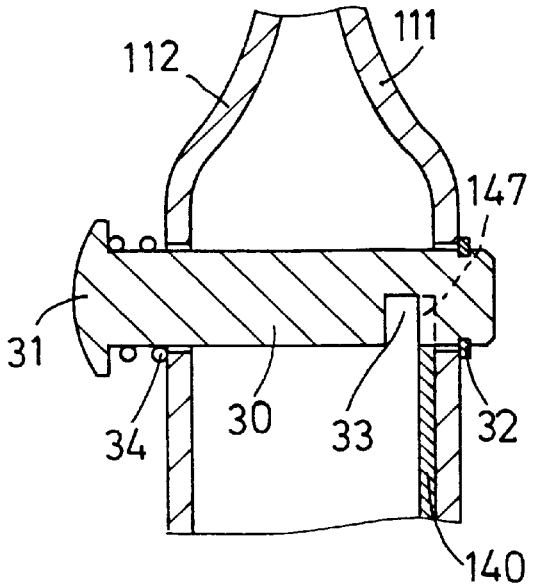
FIG. 5 is a cross sectional view taken along lines 5—5 of FIG. 2.
Figure 6:
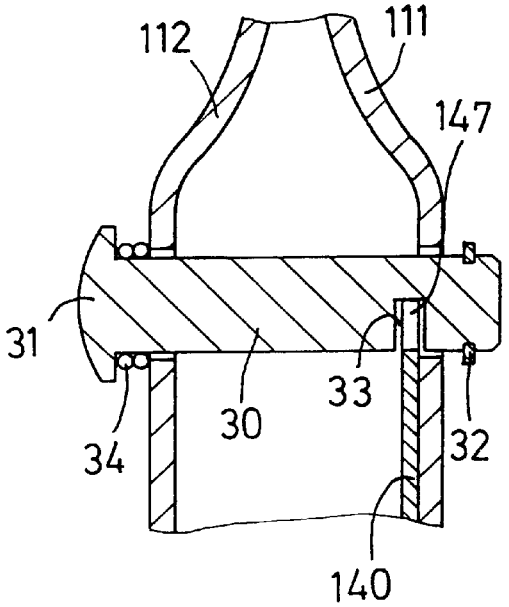
FIG. 6 is a cross sectional view similar to FIG. 5, illustrating the operation of the lock device for the wrench and plier device combination.

A latch 30 is slidably engaged through the plates 111, 112 and has an enlarged head 31 formed on one end thereof and has a clamping ring 32 secured to the other end thereof. The length of the latch 30 or the distance between the enlarged head 31 and the clamping ring 32 is greater than the width of the handle portion 11 or the distance between the plates 111, 112 for allowing the latch 30 to be slided relative to the handle portion 11 or relative to the wrench body 10. The head 31 and the clamping ring 32 may limit the relative movement between the latch 30 and the wrench body 10. The latch 30 includes a notch 33 formed therein for receiving the base wall 140 of the casing 14 (FIG. 6) and for allowing the latch 30 to be engaged into the depression 147 of the base wall 140 of the casing 14 (FIG. 5) and to lock the casing 14 to the handle portion 11 when the notch 33 of the latch 30 is disengaged from the base wall 140 (FIG. 5). A spring 34 is engaged between the handle portion 11 and the clamping ring 32 of the latch 30 for disengaging the notch 33 of the latch 30 from the base wall 140 (FIG. 5).

In operation, as shown in FIG. 5, the notch 33 of the latch 30 is normally forced to be disengaged from the base wall 140 (FIG. 5) by the spring 34 in order to lock the casing 14 to the handle portion 11 and to stably retain the plier device 20 within the casing 14. When the latch 30 is depressed against the spring 34, the notch 33 of the latch 30 may be forced to be aligned with the base wall 140 (FIG. 6) for allowing the casing 14 to be moved inward and outward of the handle portion 11 (FIG. 4) and for allowing the plier device 20 to be removed from the casing 14. The user may either push or pull the casing 14 inward and outward of the handle portion 11 (FIG. 4). Alternatively, without the latch 30, the casing 14 may be received in and secured to the handle portion 11 with a force-fitted engagement or the like.

Accordingly, the wrench and plier device combination in accordance with the present invention includes a plier device received in the wrench for allowing the users to easily obtain both or either of the wrench and the plier device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench and plier device combination comprising:

a wrench body including a first end having a wrench tool provided therein, and including a second end having a chamber formed therein, a casing rotatably secured to said second end of said wrench body at a pivot pin and rotatable inward and outward of said chamber of said wrench body, and a plier device received in said casing and received in said wrench body when said casing is received in said chamber of said wrench body.

2. The wrench and plier device combination according to claim 1, wherein said wrench tool includes a fixed jaw provided on said first end of said wrench body and includes a second jaw rotatably secured to said first end of said wrench body at a pivot shaft and rotatable toward said fixed jaw, and means for biasing said second jaw toward said fixed jaw.

3. The wrench and plier device combination according to claim 1, wherein said casing includes a space formed therein for receiving said plier device.

4. The wrench and plier device combination according to claim 1, wherein said wrench body includes a pair of plates disposed parallel to each other for forming said chamber therein.

5. The wrench and plier device combination according to claim 1 , wherein said plier device is a foldable plier device.

6. The wrench and plier device combination according to claim 1, wherein said plier device includes a pair of jaws pivotally secured together at a pivot axle, a pair of hand grips pivotally secured to said jaws respectively at a pivot rod for allowing said hand grips to be rotated and folded relative to said jaws of said plier device.

7. The wrench and plier device combination according to claim 6, wherein said hand grips of said plier device each includes a cavity formed therein for receiving said jaws of said plier device when said jaws are rotated and folded relative to said hand grips.

8. The wrench and plier device combination according to claim 3, wherein said casing includes a base wall, a pair of side walls and an end wall for forming said space therein and for receiving said plier device.

9. The wrench and plier device combination according to claim 1 further comprising means for locking said casing to said handle portion.

10. The wrench and plier device combination according to claim 9, wherein said locking means includes a latch slidably received in said handle portion and to engage with said casing to secure said casing to said handle.

11. The wrench and plier device combination according to claim 10, wherein said casing includes a base wall, said latch includes a notch formed therein for receiving said base wall of said casing and for allowing said casing to be moved inward and outward of laid chamber of said handle portion.

12. The wrench and plier device combination according to claim 11 further comprising means for biasing said latch relative to said handle portion and to disengage said notch of said latch from said base wall of said casing.

13. The wrench and plier device combination according to claim 12, wherein said base wall of said casing includes a depression formed therein for receiving said latch.

* * * * *